US006826943B2

(12) United States Patent
Rempe et al.

(10) Patent No.: US 6,826,943 B2
(45) Date of Patent: Dec. 7, 2004

(54) PROCESS FOR FORMING TUBE-SHAPED HOLLOW BODIES MADE OF METAL

(75) Inventors: Wolfgang Rempe, Hannover (DE); Franz Steimmel, Rheinbreitbach (DE); Frank Wähner, Hannover (DE)

(73) Assignee: Hydro Alumunium Deutschland GmbH, Cologne (DE)

( * ) Notice: Subject to any disclaimer, the term of this patent is extended or adjusted under 35 U.S.C. 154(b) by 0 days.

(21) Appl. No.: 09/942,268

(22) Filed: Aug. 28, 2001

(65) Prior Publication Data

US 2002/0073758 A1 Jun. 20, 2002

(30) Foreign Application Priority Data

Aug. 29, 2000 (DE) ..... 100 42 465

(51) Int. Cl.[7] ..... B21D 39/08

(52) U.S. Cl. ..... 72/370.06; 72/370.22

(58) Field of Search ..... 72/370.06, 370.22, 72/370.1

(56) References Cited

U.S. PATENT DOCUMENTS

| | | | | | |
|---|---|---|---|---|---|
| 1,980,264 | A | * | 11/1934 | Giesler | 72/370.06 |
| 3,247,581 | A | * | 4/1966 | Pellizzari | 72/370.06 |
| 3,852,987 | A | * | 12/1974 | Price et al. | 72/370.19 |
| 5,960,660 | A | * | 10/1999 | Klaas et al. | 72/58 |
| 6,260,401 | B1 | * | 7/2001 | Tada | 72/370.06 |

FOREIGN PATENT DOCUMENTS

| | | | |
|---|---|---|---|
| EP | 0 372 360 A2 | 6/1990 | B21D/53/74 |
| EP | 0 548 859 A1 | 6/1993 | B21D/26/02 |
| SU | 1 175 592 A | 8/1985 | B21D/26/02 |

* cited by examiner

*Primary Examiner*—Lowell A. Larson
(74) *Attorney, Agent, or Firm*—Proskauer Rose LLP

(57) ABSTRACT

A process for forming tube-shaped hollow bodies made of metal, particularly made of aluminum, is described. After forming a slab-shaped semifinished product into a closed cross-sectional profile and straight seam welding the opposing edges of the semifinished product, the tube-shaped hollow body is first mechanically partially expanded and/or mechanically partially reduced in an upstream processing phase. It is then soft annealed and finally hydroformed in a die by a medium introduced into the hollow body.

8 Claims, 1 Drawing Sheet

PROCESS FOR FORMING TUBE-SHAPED HOLLOW BODIES MADE OF METAL

BACKGROUND OF THE INVENTION

The invention concerns a process for forming tube-shaped hollow bodies made of metal, particularly made of aluminum, with, after shaping of a slab-shaped semifinished product into a closed cross-sectional profile, and straight seam welding of the opposite edges of the semifinished product, the tube-shaped hollow body formed being soft annealed and finally hydroformed in a die by a medium introduced into the hollow body.

Forming tube-shaped hollow bodies made out of metal by soft annealing the hollow body, further processing it depending on the requirements of the final shape sought, and finally hydroforming it in a die through a medium introduced into the hollow body is known.

Because the material solidifies during hydroforming as the forming progresses, and therefore resists further shaping or even cracks, in practice, changes of only up to approximately 10% of the cross-section relative to the initial cross-section are possible during one cycle of hydroforming.

BRIEF SUMMARY OF THE INVENTION

The object of the invention is to allow greater alterations of the cross-section.

This object is achieved in a process for forming tube-shaped hollow bodies made of metal, particularly made of aluminum.

Further developments and advantageous embodiments arise from the sub-claims.

BRIEF DESCRIPTION OF THE DRAWINGS

FIG. 1(*b*) is a partial sectional view of the body shown in FIG. 1(*a*) after processing in accordance with the principles of the invention;

FIG. 1(*c*) is a partial sectional view of apparatus that may be used to further process the body shown in FIG. 1(*b*), shown in partial sectional view, in accordance with the principles of the invention; and FIG. 1(*d*) is a partial sectional view of the apparatus and body shown in FIG. 1(*c*), when the body is in a later stage of processing than that shown in FIG. 1(*c*), in accordance with the principles of the invention.

DETAILED DESCRIPTION OF THE INVENTION

Figure 1:
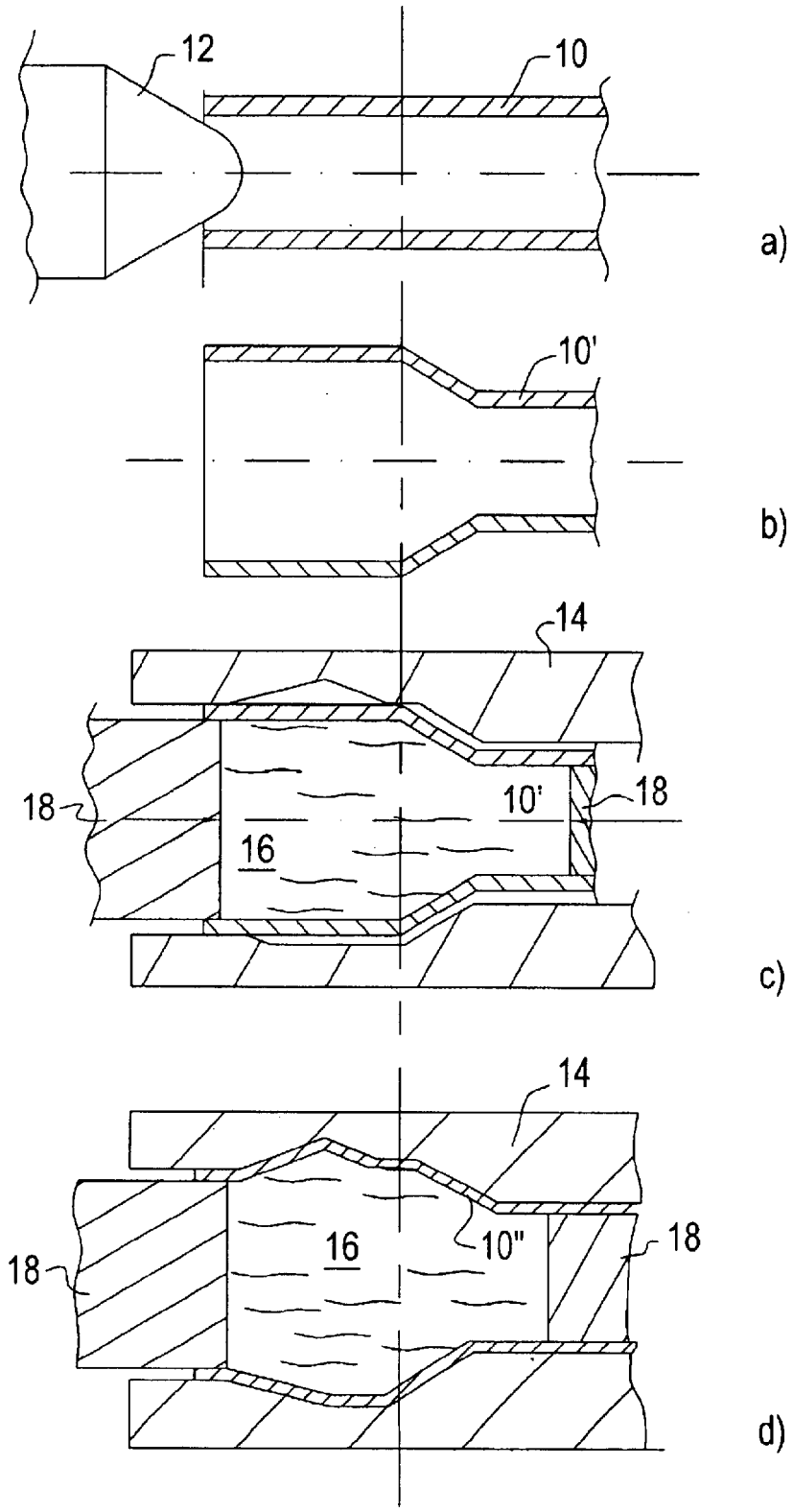
FIG. 1(*a*) is an elevational view of an apparatus that may be used to process a hollow body, such as that shown in partial sectional view, in accordance with the principles of the invention.

A process is provided for forming tube-shaped hollow bodies made of metal, particularly made of aluminum. After shaping of a slab-shaped semifinished product into a closed cross-sectional profile and straight seam welding of the opposing edges of the semifinished product to form a tube-shaped hollow body, the tube-shaped hollow body is mechanically partially expanded and/or mechanically partially reduced in an upstream processing phase, soft annealed, and finally hydroformed in a die by a medium introduced into the hollow body.

Through the upstream processing phase, the tube-shaped hollow body can already be impressed with a temporary cross-sectional shape which tends towards the final cross-sectional shape. In this way, the maximum forming length is again made available for hydroforming by the subsequent soft annealing. Therefore, during the final hydroforming, a final cross-sectional shape, which is relative to the original cross-sectional form of the tube-shaped hollow body after straight seam welding significantly greater than the maximum values achievable until now, can be achieved.

According to a further development, the processing phases of mechanical partial expansion and/or mechanical partial reduction and subsequent soft annealing can be performed multiple times in sequence. In this way, even greater forming lengths can be achieved.

In addition, the tube-shaped hollow body can also be soft annealed before the upstream processing phase. In this way, hardening due to the shaping process into a closed tube is also eliminated and a high forming reserve for the upstream processing phase is achieved.

The partial expansion and/or reduction of the tube-shaped hollow body can be performed at those locations at which the largest alteration of the cross-section after hydroforming relative to the initial cross-section occurs.

Typical further processing phases, such as mechanical bending and mechanical forming, can be performed between the processing phases of soft annealing and hydroforming.

In the following, the invention will be described with reference to FIG. 1, which shows a sequence of sequential processing phases schematically.

The starting point is a tube-shaped hollow body 10 made of aluminum with a constant annular cross-sectional area, as is illustrated in FIG. 1(*a*).

This hollow body 10 is now partially expanded by a processing tool, in this case by a conical mandrel 12, which is driven axially into the hollow body 10. For performing expansion only within the tube-shaped hollow body 10, an expandable mandrel can be used which is first inserted, then expanded, and then driven further axially over a limited path.

Subsequently, the expanded hollow body 10', as illustrated in FIG. 1(*b*), is soft annealed at approximately 300° C.

After possible further processing phases, such as bending and/or mechanical forming, hydroforming is performed in a die 14.

For this purpose, the expanded hollow body 10' according to FIG. 1(*c*) is placed in the die 14, whose internal cavity represents the future external dimensions of the hollow body 10'.

After a medium 16 is poured in and pressure is applied by the stamp 18, forming into the final shape of the hollow body 10" according to FIG. 1(*d*) then occurs.

What is claimed is:

1. A process for forming a tube-shaped hollow body, the process comprising:

shaping a slab-shaped semifinished product into a closed cross-sectional profile;

welding opposing edges of the semifinished product to produce the hollow body;

mechanically partially expanding the hollow body thereby changing the crosss-sectional area of the hollow body;

soft annealing the hollow body after the mechanically partially expanding; and hydroforming the hollow body after the soft annealing.

2. The process of claim 1 wherein the mechanically partially expanding and the soft annealing are performed multiple times in sequence.

3. The process of claim 1 further comprising soft annealing the hollow body before the mechanically partially expanding.

4. The process of claim 3 wherein the mechanically partially expanding and the soft annealing after the mechanically partially expanding are performed multiple times in sequence.

5. The process of claim 1 wherein when the hollow body has an initial cross-section and a cross-section after hydroforming, the mechanically partially expanding comprises expanding a portion of the hollow body in which the largest change between the initial cross section and the cross-section after hydroforming is to occur.

6. The process of claim 5 wherein the mechanically partially expanding and the soft annealing are performed multiple times in sequence.

7. The process of claim 1 further comprising applying further processing to the hollow body, wherein;

when the applying comprises mechanical bending or mechanical shaping, the further processing is performed between the soft annealing and the hydroforming.

8. The process of claim 7 wherein the mechanically partially expanding and the soft annealing are performed multiple times in sequence.

* * * * *